US005874975A

United States Patent [19]

Hotomi et al.

[11] Patent Number: 5,874,975

[45] Date of Patent: Feb. 23, 1999

[54] INK JET HEAD

[75] Inventors: Hideo Hotomi, Nishinomiya; Kenji Masaki, Nagaokakyo; Kusunoki Higashino, Osaka, all of Japan

[73] Assignee: Minolta Co., Ltd., Osaka, Japan

[21] Appl. No.: 611,937

[22] Filed: Mar. 6, 1996

[30] Foreign Application Priority Data

Mar. 31, 1995 [JP] Japan ..... 7-075359

[51] Int. Cl.[6] ..... B41J 2/14

[52] U.S. Cl. ..... 347/70; 347/71; 347/68

[58] Field of Search ..... 347/70, 86, 71, 347/87, 68; 310/333, 328

[56] References Cited

U.S. PATENT DOCUMENTS

| | | | |
|---|---|---|---|
| 3,946,398 | 3/1976 | Kyser et al. | 346/1 |
| 4,072,959 | 2/1978 | Elmqvist | 347/68 |
| 4,115,789 | 9/1978 | Fichbeck | 347/70 |
| 4,189,734 | 2/1980 | Kyser et al. . | |
| 5,471,232 | 11/1995 | Hosono et al. | 347/70 |
| 5,604,522 | 2/1997 | Miura et al. | 347/70 |

FOREIGN PATENT DOCUMENTS 6-182998 7/1994 Japan .

*Primary Examiner*—Peter S. Wong
*Assistant Examiner*—Rajnikant B. Patel
*Attorney, Agent, or Firm*—Sidley & Austin

[57] ABSTRACT

Disclosed is an ink jet recording apparatus and an ink jet head which ejects an ink droplet from an ink chamber via an orifice in response to transformation of a piezoelectric member. The ink jet head has a non-piezoelectric member having a groove; a film provided on the non-piezoelectric member to cover the groove, a space formed between the groove and the film being used as the ink chamber; and a piezoelectric member provided on the film corresponding to the ink room. The piezoelectric member has a plurality of surfaces one of which is fixedly connected with the film corresponding to the ink room and other of which are facing to air.

31 Claims, 10 Drawing Sheets

PRIOR ART

INK JET HEAD

BACKGROUND OF THE INVENTION

1. Field of the Invention

The present invention relates to an ink jet head of an ink jet recording apparatus that records onto a recording medium such as paper by ejecting ink droplets in response to an image signal.

2. Description of Related Art

Conventionally, an ink jet head that ejects ink droplets from a nozzle has been used in a recording apparatus such as a printer. In this ink jet head, in response to an image signal a voltage is applied to a piezoelectric body which is provided corresponding to an ink chamber. The piezoelectric body is deformed based on the application of voltage after which the ink is pressurized based on this deformation of the piezoelectric body ejecting the ink from the nozzle. In this recording apparatus, the ink droplets from the nozzle are propelled onto a medium to be recorded such as paper to form an ink image on the recording medium.

For this type of ink jet head, for example, the ink jet head shown in FIG. 1 has been proposed in Japanese Unexamined Laid-open patent Hei 6-143563. This ink jet head 70 has a construction in which an elastic membrane 73 is joined to the top of a flowpath substrate 72. In the flowpath substrate 72, concave portions 71 are formed in parallel on the surface where the elastic membrane 73 is joined. The space formed between this concave portion 71 and elastic membrane 73 is used as an ink chamber 74. On the top of this elastic membrane 73 are arranged a plurality of layered vibrators for the drive 76 and two layered vibrators for the dummy 77. Each of the vibrators for the drive 76 and the vibrators for the dummy 77 is a layered piezoelectric body which is superimposed thin piezoelectric layers and thin electrode layers alternatively. The vibrators for the drive 76 and the vibrators for the dummy 77 are attached onto a substrate 75. The vibrators for the drive 76 and the vibrators for the dummy 77 are bodies which were separated by a slit process after attaching a flat plate of one piezoelectric vibrator to the substrate 75. Then, the integrated unit comprising flowpath substrate 72, elastic membrane 73, piezoelectric vibrator layers 76, 77 and the substrate 75 are held by two rigid fixing plates 78, 79.

In an ink jet head 70 constructed this way, ink droplets are ejected from a nozzle by means of applying a voltage to the vibrator for the drive 76 which deforms the vibrator and by changing the capacity of the ink chamber 74 via the elastic membrane 73 to pressurize the ink.

Furthermore, in the above-mentioned ink jet head 70, there is solid attachment of the entire surface between each of the vibrators for the drive 76 and the substrate 75 which extend in the depth direction (i.e., a direction orthogonal to the paper plane in FIG. 1). Therefore, the vibrations of the separated vibrators 76 propagate to the adjacent vibrators 76 through the substrate 75 also causing a coupled displacement to occur. Because of this, there is a possibility that problems will occur in which there is an unnecessary discharge of ink droplets from the ink chamber 74 as well as irregularity in the ink flow inside the ink chamber 74 even though the ink does not discharge resulting in undesired diameter of the ink droplets at the subsequent discharge. In other words, a mutual interference in the ink discharge characteristics which is called "cross talk" occurs resulting in poor printing quality.

Further, as a form of another ink jet head, a Kayser system ink jet head that has a vibration plate arranged in the ink chamber that is filled up with ink is well known. This vibration plate has a bimorph construction in which two or more layers of a piezoelectric member such as PZT and a metal plate are cemented (for example U.S. Pat. No. 3,946,398). In an ink jet head using the Kayser system, a voltage is applied to the vibration plate which deforms the vibration plate and then based on this deformation, the ink is pressurized and subsequently discharged.

The vibration plate in ink jet head using the above-mentioned Kayser system is comprised by a piezoelectric member. Moreover, this piezoelectric material has a construction such that it makes direct contact with the ink. Therefore, there are problems such as ink soaking into the piezoelectric material, the effective voltage applied to the piezoelectric body dropping, and the inability to obtain sufficient discharge of ink droplets.

SUMMARY OF THE INVENTION

Accordingly, the object of the present invention is to solve the above-mentioned problems by providing an ink jet recording apparatus that can achieve a stable discharge of ink droplets. A further object of the present invention is to provide an ink jet recording apparatus that can achieve stable ink ejection without any cross talk thereby improving the printing quality. An even further object of the present invention is to provide an ink jet recording apparatus that can easily achieve higher density dot printing by means of increasing the number of nozzles resulting in high speeds.

To achieve the above-mentioned objects, the ink jet recording apparatus of the present invention includes a member made of a non-piezoelectric material in which an ink chamber is formed, with the ink chamber having a wall consisted with a membrane which forms part of an outer wall of said member. Also included is a piezoelectric member which has a plurality of electrodes, and having a first surface and a second surface that is opposite to said first surface, where the first surface is fixedly connected with the membrane, and the second surface is facing to air.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
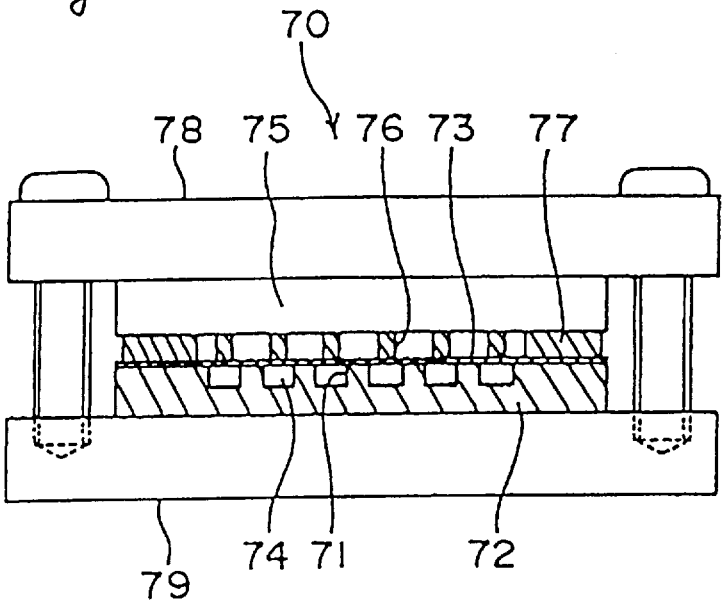
FIG. 1 shows a partial sectional view of an example of a conventional ink jet head.

Referring now to the drawings, one preferred embodiment of the present invention will be described.

Figure 2:
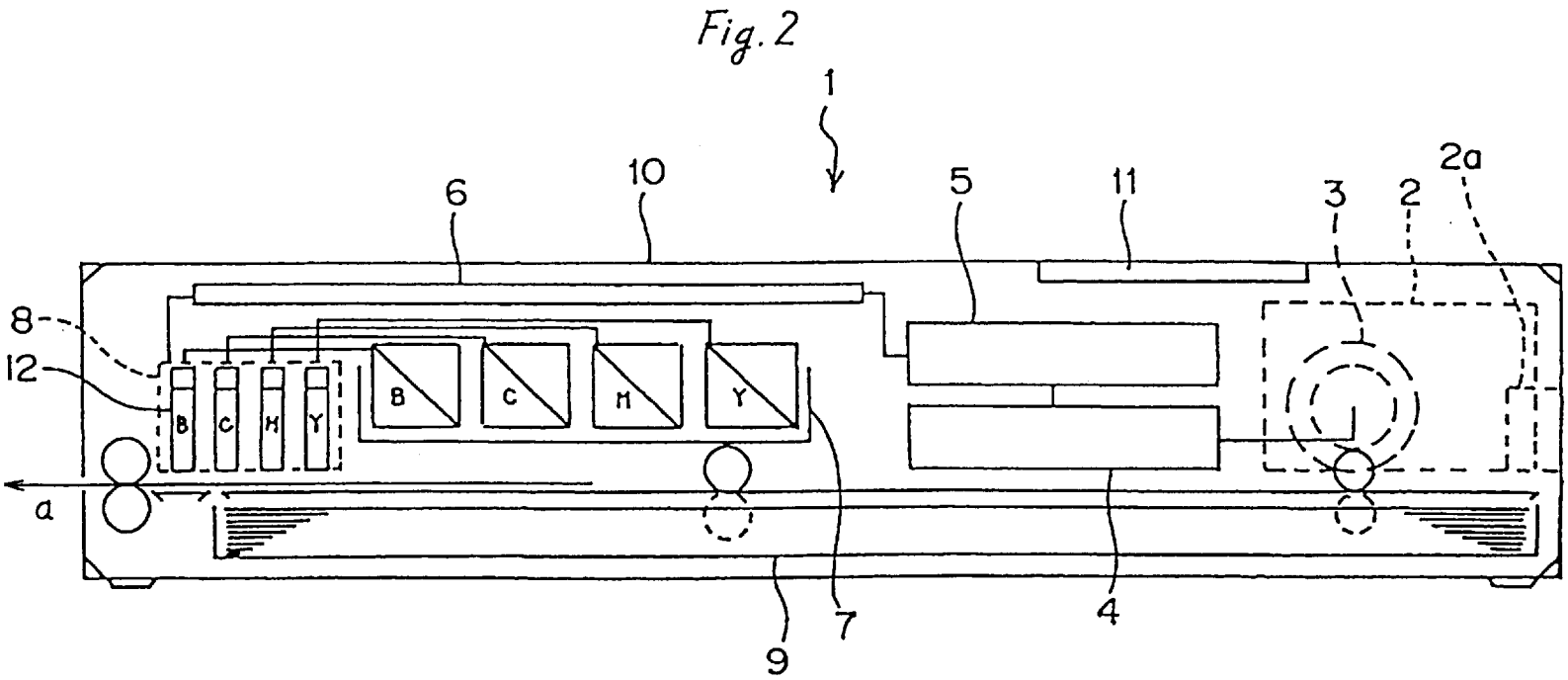
FIG. 2 shows a sectional view showing an outline of the construction of the ink jet recording apparatus.

FIG. 2 is a sectional view that roughly shows the overall construction of the ink jet recording apparatus 1. This ink jet recording apparatus 1 is roughly comprised from a power supply 2 equipped with a connector 2*a*, a drive system 3, a controller 4 for controlling mechanisms, a memory 5, a controller 6, an ink supply portion 7, a scan carriage 8, a feeder portion 9, a case 10, and an operation panel 11. The above-mentioned scan carriage 8 can scan in a direction (i.e., a direction orthogonal to the paper plane in FIG. 2) at a right angle to the direction the paper passes (direction of arrow a). Inside the carriage along the direction the paper passes are arranged four ink jet heads 12 for each color of black, cyan, magenta and yellow as well as ink discharge nozzles which face downward.

Figure 3:
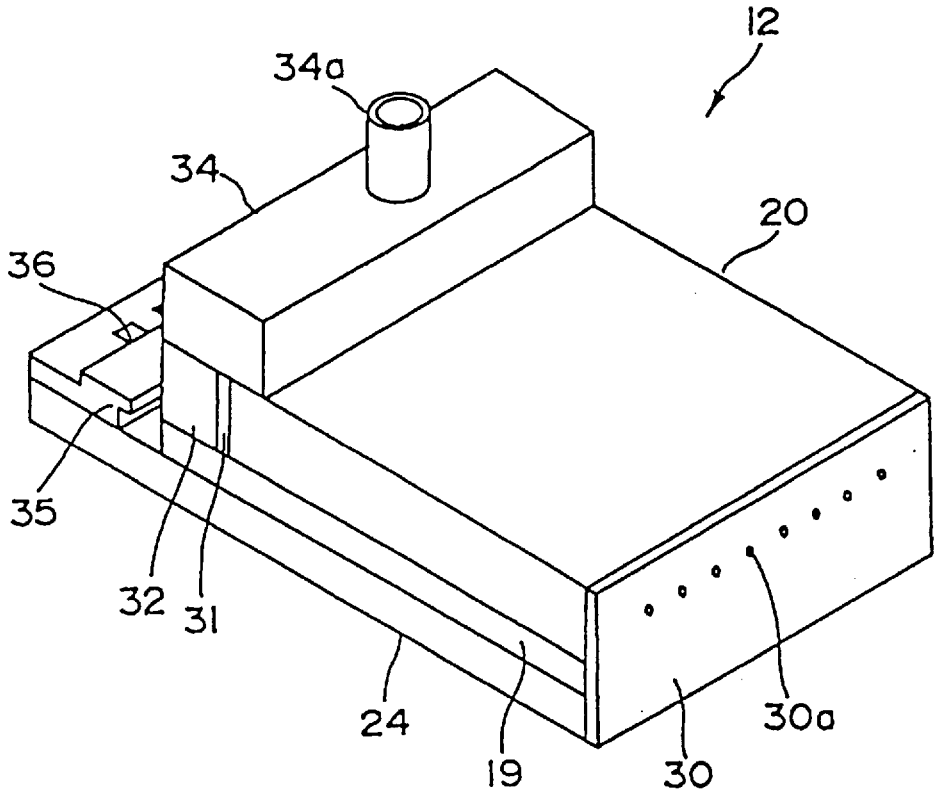
FIG. 3 shows a perspective view of the entire ink jet head.
Figure 4:
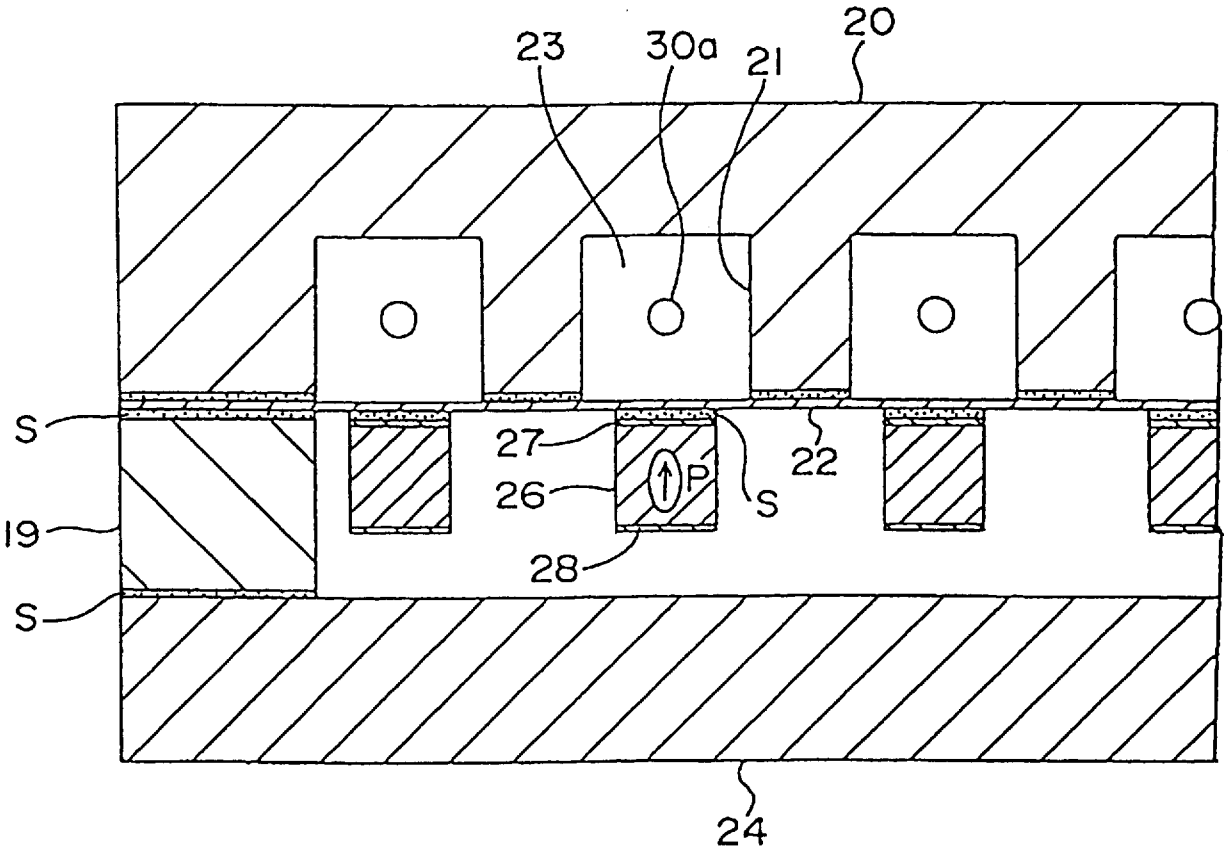
FIG. 4 shows a crosswise sectional view of the ink jet head shown in FIG. 3.

As shown in FIG. 3, the above-mentioned ink jet heads 12 are provided with a top plate 20 that is a first non-piezoelectric material. This top plate 20 is a plate which is comprised by, for example, a non-piezoelectric material such as alumina. As shown in FIG. 4, a plurality of channel-shaped concave portions 21 are formed on the lower surface of the top plate 20 by means of a dicing process, etc. These concave portions 21 are formed at a fixed pitch in the axial direction of the top plate 20 and they extend in the lengthwise direction of the top plate 20 parallel to each other.

A partition 22 comprised by, for example, an aramid resin is provided on the surface where the concave portion 21 of the top plate 20 forms and is solidly attached at the contact surface with the top plate 20. This partition 22 is also composed of a non-piezoelectric material. An ink chamber 23 is thus formed inside each concave portion 21 which is covered by this partition 22.

For the above-mentioned partition 22, a plurality of piezoelectric bodies 26 which are opposite to each ink chamber 23 are provided on the side opposite the partition 22. Each of the piezoelectric bodies 26 is solidly attached to the partition by means of adhesive layer s. Each of the piezoelectric bodies 26 is formed by cutting a plate composed of, for example, a PZT piezoelectric ceramic using a dicing saw and has a rectangular cross section. Further, each of the piezoelectric bodies 26 forms a long slender strip-shaped body in the direction along the ink chamber 23. A common electrode 27 is formed on the upper surface of the piezoelectric body 26 and an individual electrode 28 is formed on the lower surface of the piezoelectric member 26. These electrodes are formed by means of attaching either an Au/Ni film by a plating method or an Au/(Ni, Cr) film by sputtering on the upper and lower surfaces of the piezoelectric ceramic plate before it undergoes the above-mentioned cutting. The thickness of the film is from approximately 0.1 $\mu$m to 10 $\mu$m. Moreover, each of the piezoelectric bodies 26 is polarized in the direction (direction of arrow P) from the individual electrode 28 toward the common electrode 27. It is preferable for the common electrodes 27 provided on the piezoelectric bodies 26 to be connected to one electrode line by means of a leader line and this electrode line to be grounded.

Furthermore, in order to prevent lowering of the amount of deformation that occurs when a voltage is applied due to penetration of moisture in the atmosphere, it is preferable to carry out an overcoat process to the surface of the piezoelectric body 26. For this overcoat process, a polyimide resin, for example, is applied to the surface of the piezoelectric member using a spin coat method and then baked for 1 hour at 180° C. Because the piezoelectric body 26 of this embodiment makes contact with the atmosphere at surfaces other than the contact surface with the partition 22 (upper surface of the piezoelectric body 26), the overcoat process is effective for this ink jet head. However, this process can be omitted when a piezoelectric member with a high humidity resistance is used as the piezoelectric body 26.

Spacers 19 (only one side shown in figure) are each solidly attached to partition 22 in the crosswise direction on both sides of the above-mentioned top plate 20. A substrate 24 that is a second non-piezoelectric material covering the lower area of each piezoelectric body 26 is solidly attached to the lower portion of the spacers 19. This substrate 24 faces the surfaces of the individual electrodes 28 of the piezoelectric bodies 26 with an air gap between them. The substrate 24 comprises a plate which is made of a non-piezoelectric material like the top plate 20. In this way, each of the piezoelectric bodies 26 is fixed to and supported by only the partition 22 without being fixed to another member at all.

Further, the spacers 19 and the substrate 24 are fixed to the top plate 20 by means of a tightening tool such as two fixing plates and bolts to grip the spacer and substrate from the upper and lower directions. In addition, a method that integrally undergoes a resin molding around their periphery can also be used. Furthermore, these methods can also be used together.

Figure 5:
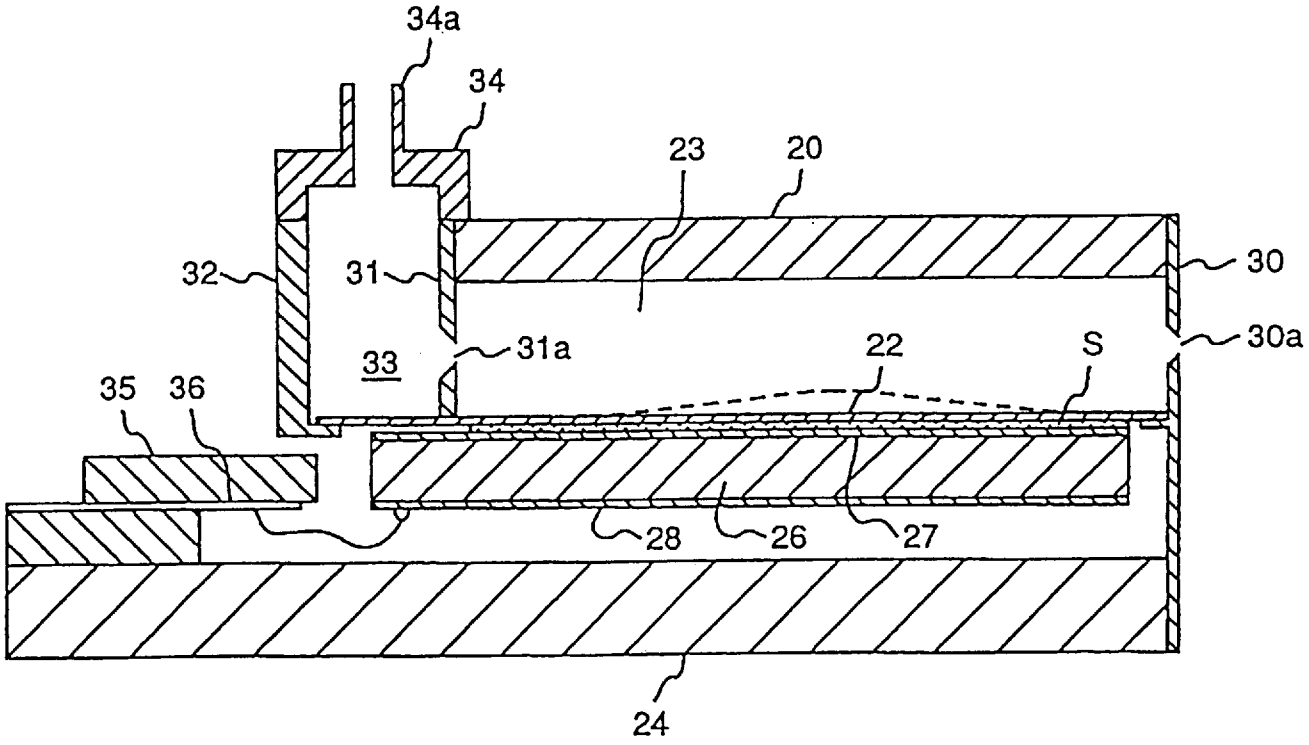
FIG. 5 shows a lengthwise sectional view of the ink jet head shown in FIG. 3.

On the surface of the front end of the integrated unit of the above-mentioned top plate 20, partition 22, spacers 19, and substrate 24, a nozzle plate 30 is solidly attached as shown in FIG. 3 or FIG. 5. This nozzle plate 30 is composed of, for example, polyimide film approximately 25 to 200 $\mu$m thick. On nozzle plate 30, a plurality of nozzle holes 30*a* are formed at a pitch equal to the spacing of the above-mentioned ink chamber 23 by means of, for example, an excimer laser. This pitch is, for example, approximately 42.3 to 254 $\mu$m (pixel density: 600 to 100 dpi).

As shown in FIG. 5, an orifice plate 31 is attached to the surface of the rear end of the above-mentioned top plate 20. This orifice plate 31 has ink supply opening 31*a* that corresponds to the ink chambers 23, respectively. Further, looking from the top of FIG. 5, a C-shaped backplate 32 is attached to orifice plate 31. An ink distribution path 33 is formed between the backplate 32 and the orifice plate 31. The ink distribution path 33 connects to all the ink supply openings 31*a* and has an opening in the upward direction. The rear end of the above-mentioned partition 22 is attached to the lower portion of the backplate 32, sealing shut the lower direction of the ink distribution path 33. The rear upper portion of the top plate 20 is connected to an ink manifold 34 that covers the above-mentioned ink distribution path 33. An ink tube 34*a* is provided protruding on the upper portion of the ink manifold 34.

The individual electrodes 28 of the rear ends of the above-mentioned piezoelectric bodies 26 are connected to leader lines 36 that correspond to the piezoelectric members 26, respectively, by means of wire bonding or similar method. Leader line 36 is supported on a leader line support member 35. Furthermore, leader line 36 is connected to a controller 6 (see FIG. 2) which is a voltage application device operated by a drive IC (not shown in figure). voltage is applied to the piezoelectric body 26 in response to image signals by means of this controller 6.

On the other hand, the common electrodes 27 on the upper surface of the piezoelectric bodies 26 are grounded. Although this connection to ground is not shown in the figure, there are methods to establish the ground. For example, by forming the partition 22 from a resin or a metal which has conductive properties and then grounding the electrode to the partition 22 at only one location. In addition to this, forming a conductive adhesive agent layer which provides continuity to all the common electrodes 27 by attaching the partition 22 to each piezoelectric body 26 using a conductive adhesive agent to establish a ground at one location only on the adhesive agent layer can also be used. For the latter case, the partition need not be conductive.

Continuing, the ink discharge operation of the ink jet head 12 having the above-mentioned construction is described next.

As shown in FIG. 5, the ink is supplied from the ink supply portion 7 (see FIG. 2) to the ink tube 34*a* and fills up each ink chamber 23 via the ink distribution path 33 and the ink supply opening 31*a*.

Figure 6:
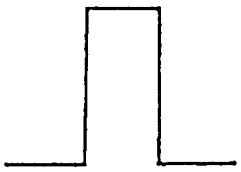
FIGS. 6(*a*)–6(*g*) shows the pulse waveforms of voltage applied to the piezoelectric body.
Figure 6B:
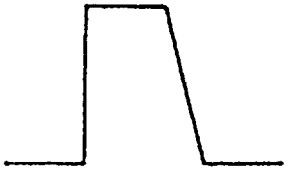
Figure 6:
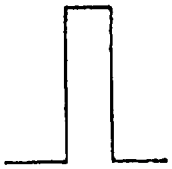
Figure 6D:
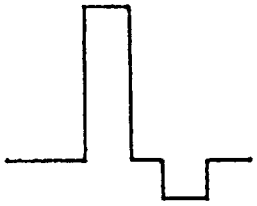
Figure 6E:
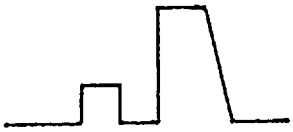
Figure 6F:
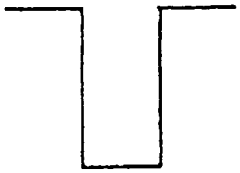
Figure 6:
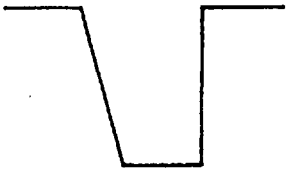
Figure 7:
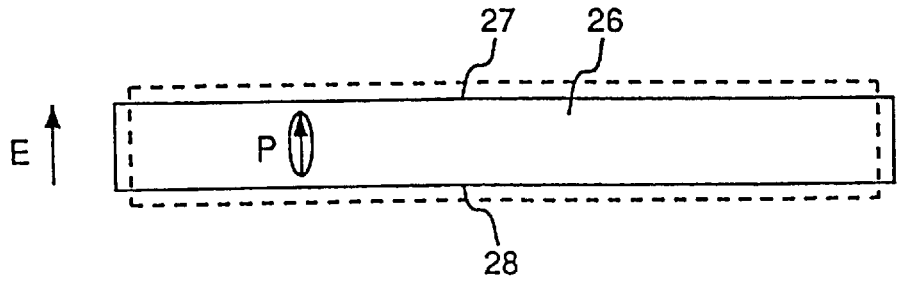
FIGS. 7(*a*)–(*c*) show the polarization direction of the piezoelectric body, the direction the electric field forms and a modified state when voltage is applied.
Figure 7:
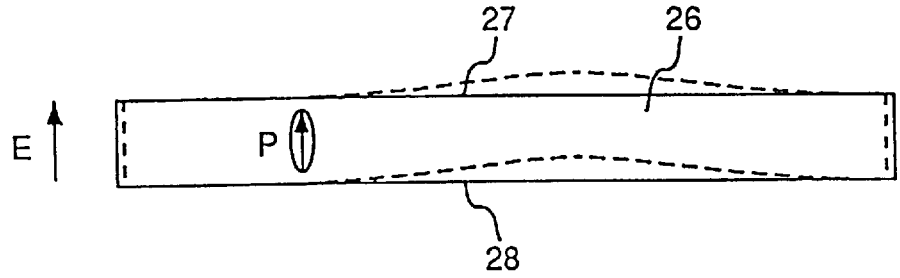
Figure 7:
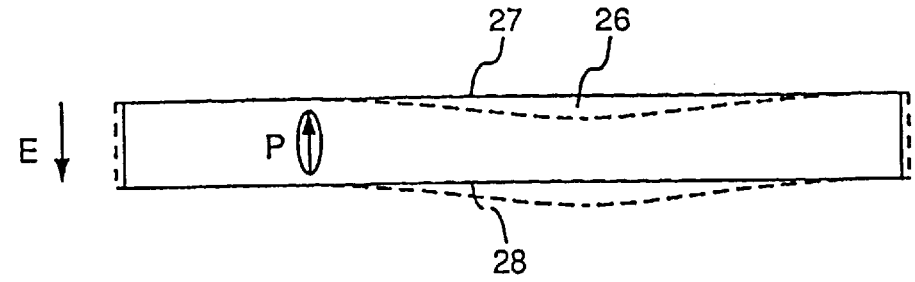

As shown in FIG. 7(*a*) and FIG. 7(*b*), when a voltage pulse with a positive polarity as shown in FIG. 6(*a*) is applied to the individual electrode 28 of the piezoelectric body 26, an electric field is formed in the piezoelectric body 26 in a direction (direction of arrow E) away from the individual electrode 28 towards the common electrode 27 or, in other words, parallel to the polarization direction (direction of arrow P). By means of this electric field, the piezoelectric body 26 deforms and vibrates in a direction along the ink chamber 23 by the so-called thickness direction vibration mode (lengthwise vibration mode when seen in the lengthwise direction of the piezoelectric member 26). Hereupon, for a case when the piezoelectric body 26 is not solidly attached at all, as shown by the broken lines in FIG. 7(*a*), the piezoelectric body 26 will keep on expanding in the thickness direction by means of the voltage application and then contract and deform in the lengthwise direction and the depth direction. In this embodiment, because the piezoelectric body 26 is attached to the partition 22 by means of an adhesive layer s, the contraction deformation is restricted on the attachment surface of the piezoelectric body 26 that formed the common electrode 27. Therefore, the amount of contraction of the non-attachment surface that formed the individual electrode 28 grows larger. Thereby, as shown by the broken lines in FIG. 7(*b*), the piezoelectric body 26 curves and deforms toward the attachment surface side. By means of this deformation, as shown by the broken lines in FIG. 5, the partition 22 is forced up sharply reducing the capacity of the ink chamber 23. By this reduction of capacity, the pressurized ink forms into a droplet and is then ejected from a nozzle hole 30*a* to adhere to recording paper (not shown in figure).

When the application of voltage to the individual electrode 27 is released and the electric field disappears, the piezoelectric body 26 returns to its original state and the partition 22 is also restored simultaneously. At this moment, the capacity of the ink chamber 23 increases and a negative pressure occurs inside the chamber. By means of this negative pressure, ink is supplied to the ink chamber 23 via the manifold 34, ink distribution path 33 and ink supply opening 31*a* allowing preparation for the next ink discharge.

However, as shown in FIG. 6(*a*), during the above-mentioned ink supply, when the voltage momentarily drops to 0 (zero) causing the partition 22 to be restored based on the elasticity of the piezoelectric member 26 which then sharply increases the capacity of the ink chamber 23, there is a possibility that air bubbles will be aspirated from the nozzle hole 30*a* into the ink chamber 23. When the air bubbles are aspirated, there is a danger that the air bubbles will absorb the pressure during the application of the next voltage pulse thereby preventing the ink from being ejected. Thus, as shown in FIG. 6(*b*), it is effective that the piezoelectric body 26 provides a slant to the shape of the voltage pulse during the restoration action and to make the piezoelectric body 26 and the partition 22 return to their original states as quickly as possible but in a range in which aspiration of air bubbles does not occur.

Further, in contrast to FIG. 6(*a*), if a voltage pulse with an altered pulse width is applied at the same voltage level to adjust the amount of deformation of the piezoelectric body 26, the diameter of the ink droplets to be ejected can be altered thereby changing the diameter of the dots which will adhere onto the recording paper thereby allowing halftone reproduction. For example, as shown in FIG. 6(*c*), if the pulse width is made smaller, the dot diameter becomes smaller.

The voltage pulse shown in FIG. 6 (*d*) is the one that apples a subsequent pulse which has an opposite polarity and a smaller voltage to the main pulse. If a voltage pulse having this waveform is applied to the piezoelectric body 26, the ink column extending from the nozzle hole 30*a* is forcibly drawn into the ink chamber 23 by means of the sub-pulse after the ink droplets are propelled by the main pulse thereby allowing reductions in satellite noise.

The voltage pulse shown in FIG. 6 (*e*) is one that applies a pre-pulse which has the identical polarity but a smaller voltage to the main pulse. The voltage value of the main pulse can be held low by means of a voltage pulse having this waveform thereby reducing the load on the driver. Therefore, the cost of the driver can be reduced.

One line of an image is drawn by independently carrying out the above-mentioned type of ink discharge operation for each ink chamber 23 in response to image signals. By repeatedly forming one line of an image in synchronization with the movement of the recording paper, the image is drawn on the recording paper in response to image signals.

In this embodiment as described above, the piezoelectric body 26 is fixed to the partition 22 only via the adhesive layer without being fixed to any other member. Therefore, coupled displacement can be completely suppressed without the vibration of one piezoelectric body 26 propagating to another adjacent piezoelectric body 26 via the substrate 24 as in a conventional ink jet head. Moreover, because the entire contact portion with the top plate 20 of the partition 22 is attached with the top plate 20, there also is no propagation of vibrations via the partition 22. Therefore, there also is no needless ink discharge due to cross talk or irregularity in the ink flow inside the ink chamber 32, allowing extremely stable ink discharge. As a result, the dot diameter is stabilized without unevenness between the dots of the propelled ink droplets thus allowing the printing quality to be improved by a remarkable degree.

Furthermore, according to the construction described in this embodiment, the amount of pushup force applied to the partition 22 based on the deformation of the piezoelectric body 26 can be made large. Therefore, compared to a conventional ink jet head, the same degree of ink ejection can be achieved at a lower voltage. As a result, driver ICs with economical low voltages (for example, 60 volts or less) can be used thereby allowing reductions in the cost of the drivers.

Even further, compared to a conventional Kayser system ink jet head, it is easy to arrange piezoelectric bodies 26 equivalent to an electrostrictive element in high density. Thereby making it possible to increase the number of nozzles at a low cost allowing higher printing speeds.

Hereupon, in the above-mentioned embodiment, applying the voltage pulses shown in FIG. 6 (*a*) to FIG. 6 (*e*) causes the piezoelectric body 26 to contract and deform in the lengthwise direction and, based on this deformation the partition 22 is forced up which ejects the ink after which the ink is replenished when the partition 22 and the piezoelectric body 26 are restored. In contrast to this, the voltage pulses with opposite polarity shown in either FIG. 6 (*f*) or FIG. 6 (*g*) can be applied to the piezoelectric body 26. For this case, as shown in FIG. 7 (*c*), an electric field is formed in the piezoelectric body 26 in a direction (i.e., direction of arrow E) away from the common electrode 27 towards the individual electrode 28 expanding and deforming the piezoelectric body 26 in the lengthwise direction. However, because the deformation of the piezoelectric body 26 at the attachment surface is restricted, the amount the piezoelectric member stretches at the non-attachment surface where the individual electrode 28 is formed increases. As a result, the piezoelectric body 26 curves and deforms toward the non-attachment surface side. By means of this deformation, the capacity of the ink chamber 23 increases and the ink is replenished and then by releasing the application of voltage, the piezoelectric body 26 restores its original shape and the ink is propelled at that time. Hereupon, the reason the rising portion of the pulse in FIG. 6 (*g*) is slanted is identical to the above-mentioned case of FIG. 6 (*b*).

Moreover, there are methods other than applying the voltage pulses of FIG. 6 (*f*) and FIG. 6 (*g*) to cause deformation such that the piezoelectric body 26 curves toward the non-attachment surface side when the voltage is applied. These include reversing the polarization direction of the piezoelectric body 26 or changing the hardness of the adhesive surface s or the elasticity constant of the partition 22.

Next, referring to FIG. 8 to FIG. 10, a modified embodiment of the above-mentioned embodiment will be described. However, members and functional effects other than those specially mentioned will be omitted from the description since they are identical to the above-mentioned embodiment.

Figure 8:
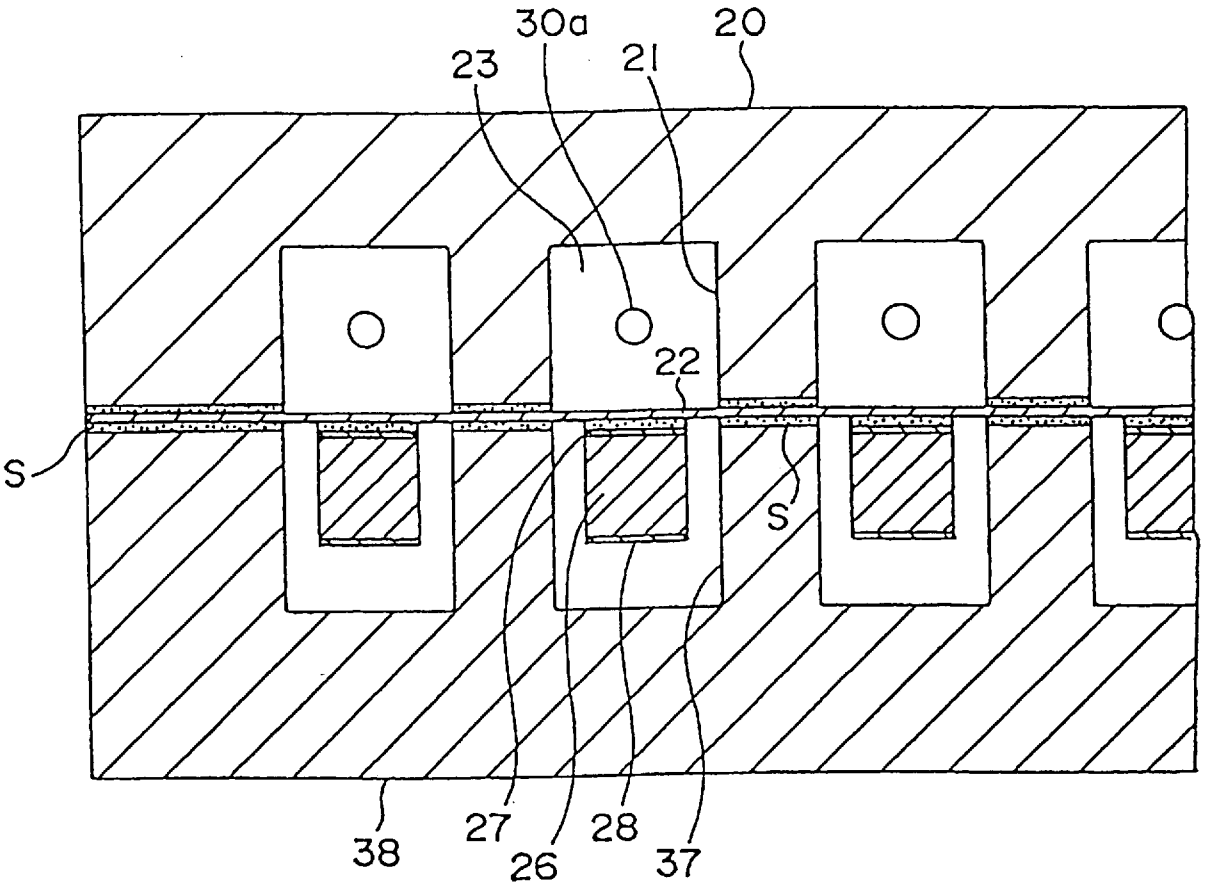
FIG. 8 shows a modified example of the ink jet head.

As shown in FIG. 8, in place of the spacers 19 and the substrate 24 of the above-mentioned embodiment, a substrate 38 can be used where the surface opposite the partition 22 has formed thereon a plurality of channel portions 37 which correspond to each concave portion 21 of the top plate 20. This substrate 38 is fixed against the top plate 20 by means of adhesive layer s and the partition 22 in a state in which the piezoelectric bodies 26 attached to the partition 22 are each housed inside each of the above-mentioned channel portions 37. Further, the piezoelectric body 26 for this also does not make contact with the surface of the wall inside the above-mentioned channel portion 37 and is attached to the partition 22 only. Namely, each piezoelectric body 26 is opposite to the concave portion 21 forming an air-gap without making contact with the wall inside the concave portion 21 of the substrate 38.

According to the ink jet recording apparatus that uses the above-mentioned substrate 38, even when twisting occurs in the deformation of the piezoelectric body 26, the surface of the side wall of the above-mentioned channel portion 37 carries out the function of a guide to reliably direct the deformation of the piezoelectric body 26 in the direction that either reduces or increases the capacity of the ink chamber 23. Thereby achieving a stable ink ejection without the diameter of the ink droplets losing their uniformity.

Furthermore, the partition 22 is fixed by being held between a leading edge of a convex portion that divides each concave portion 21 of the top plate 20 and a leading edge of a convex portion that divides each channel portion 37 of the substrate 38. Thus, vibrations of the partition 22 forming one wall of the ink chamber 23 that propagate to other ink chambers 23 can be more completely cut off allowing the generation of cross talk via the partition 22 to be reliably prevented.

Even further, because the structural strength of the partition 22 that forms one wall of the ink chamber 23 is increased by means of fixing the partition from the upper and lower directions, the life of the partition 22 is extended increasing the durability of the system. Moreover, because the dampening of the vibrations becomes quicker, the subsequent ink ejection can also be carried out fast. As a result, the high-frequency response characteristics are improved allowing faster printing speeds.

Figure 9:
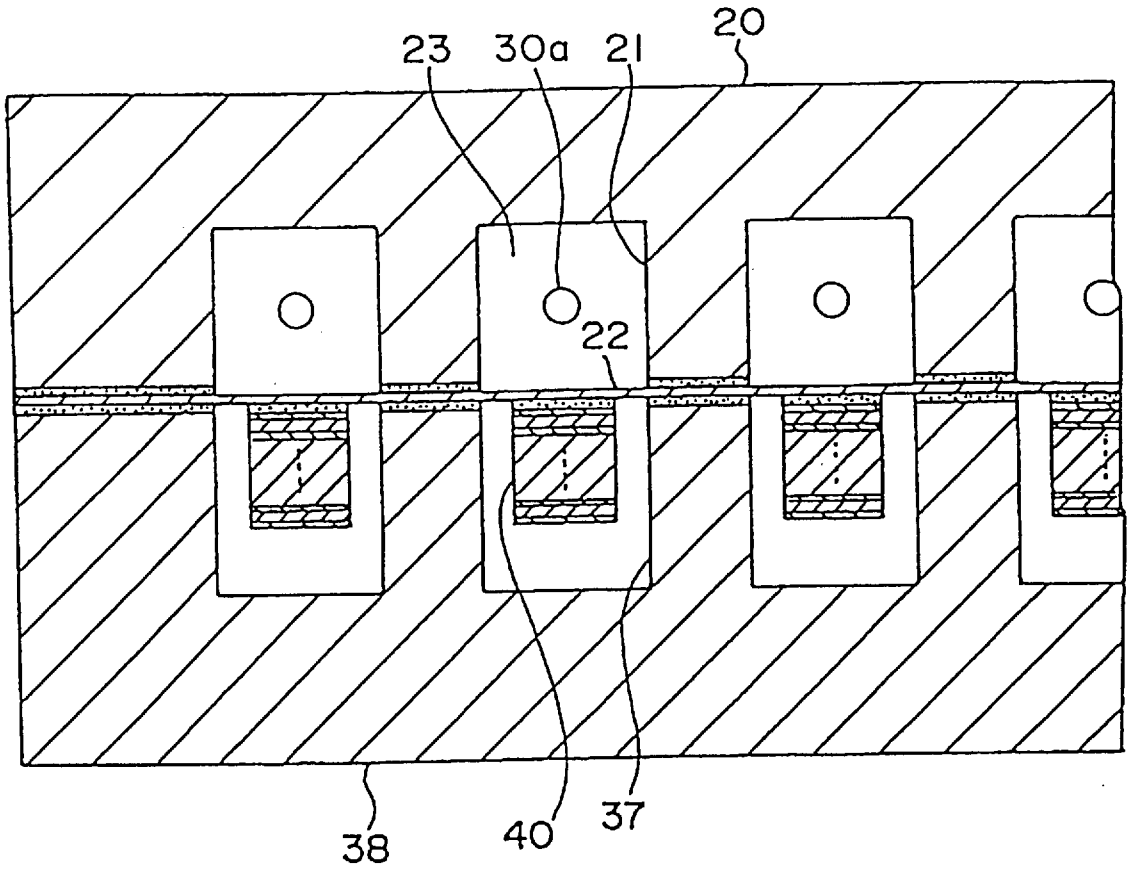
FIG. 9 shows a crosswise sectional view of the ink jet head using a layered type piezoelectric member.
Figure 10:
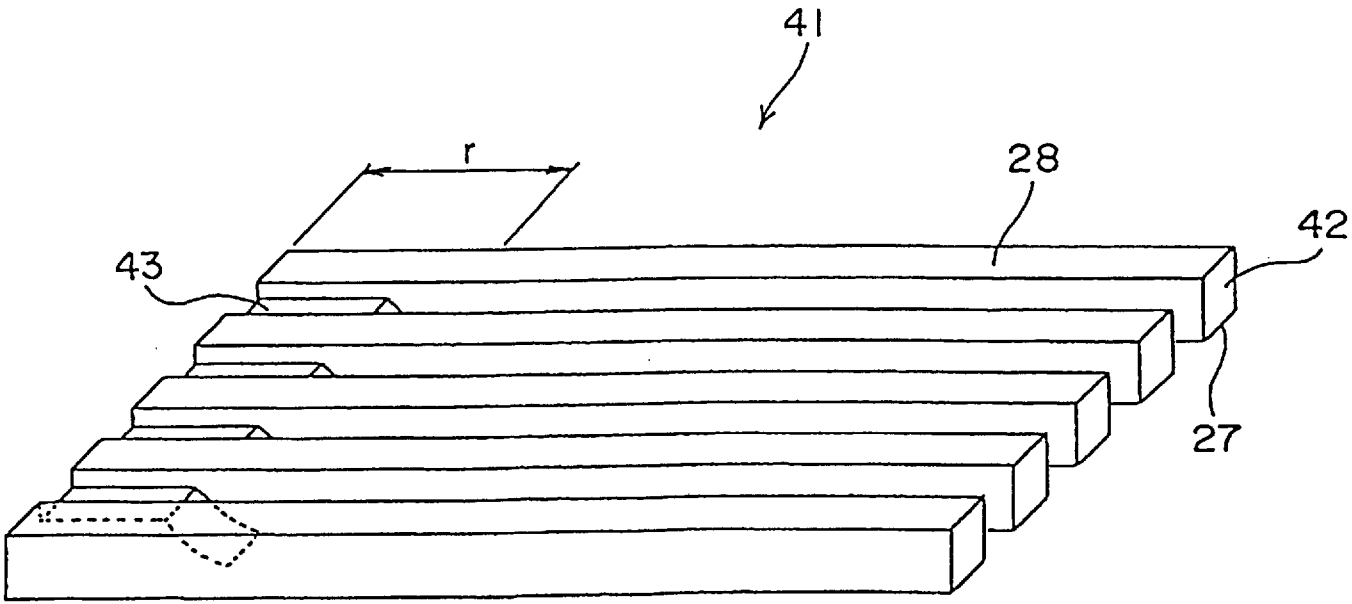
FIG. 10 shows a perspective view of a piezoelectric member formed in a comb-toothed shape.

In the above-mentioned embodiment and its modified embodiment, although a single layer piezoelectric body 26 was used, as shown in FIG. 9, a layered type piezoelectric member 40 can be used. The layered type piezoelectric member 40 is a device formed by laminating two or more layers of piezoelectric material by means of the well-known green sheet method with an individual electrode and a common electrode serving as the attachment layer being formed inside. If a layered type piezoelectric member 40 is used, it is possible to obtain a large effective displacement in proportion to the number of layers, thereby allowing the drive voltage to be lowered reducing the cost of the driver. Moreover, for this case as well it is preferable to use the above-mentioned substrate 38 in which the channel portion 37 is formed to guide the deformation of the layered type piezoelectric member 40.

Furthermore, in the above-mentioned embodiment and its modified embodiment, an example was described in which each piezoelectric body 26 is completely divided and formed into a long, slender, strip-shaped body by means of a dicing process on a flat piece of piezoelectric material. However, the shape of the piezoelectric body is not restricted to this and, as shown in FIG. 10, a piezoelectric member 41 formed into a so-called comb-toothed shape can also be used. In the region corresponding to the ink chamber 23, this piezoelectric member 41 is divided into long, slender strip-shaped bodies which become each piezoelectric member 42. However, each piezoelectric member 42 is coupled by means of a coupling portion 43 having a surface one level lower than the formation surface of the individual electrode 28 in the rear region r of that piezoelectric member.

The coupling portion 43 is formed by means of making the cutting depth shallow at the area of the coupling portion 43 while the plate-shaped piezoelectric material undergoes slit processing by means of a dicing saw. Further, the individual electrode 28 is not formed in the rear region r of each piezoelectric body 42 which corresponds to this coupling portion 43. This is because vibrations between each piezoelectric body 42 are prevented from affecting each other such that deformation does not occur in this rear region r.

Thus, by forming the piezoelectric body 42 in a comb-toothed shape, the structural strength of each piezoelectric body 42 is increased improving the durability and reliability of the system. Moreover, because the handling of the system during processing and assembly becomes easier and assembly inconsistencies decrease with increased precision, the yield rate improves allowing manufacturing costs to be reduced. Further, by the existence of the coupling portion 43, the common electrodes 27 of each piezoelectric body 42 are also made common to each other with continuity between each electrode, thereby making it possible to ground the common electrodes 27 of each piezoelectric body 42 with only one connection without using a conductive adhesive agent layer. Therefore, the ground connection can be easily established.

[Material Used For Each Member]

Next, materials which can be used in the above-mentioned first to fifth embodiments and their modified embodiments are described.

Piezoelectric Material

The piezoelectric materials listed below can be used for the material of the above-mentioned piezoelectric bodies 26, 40 and 42.

(1) Piezoelectric crystals

Crystals including crystal ($SiO_2$), Rochelle salt (RS: $NaKC_4H4O_6.4H_2O$), ethylenediamine tartrate (ETD: $C_6H_{14}N_2O_6$), potassium tartrate (DKT: $K_2C_4H_4O_6$-½$H_2O$), secondary ammonium phosphate (ADP: $NH_4H_2PO_4$), perovskite family crystal (ex. $CaTiO_3$, $BaTiO_3$, PLZT), tungsten bronze family crystal (ex. $Na_xWO_3$ [0.1<x<0.28]), barium sodium niobate ($9NaN_{12}O_{15}$), potassium lead niobate ($P_9KN_{12}O_{15}$), lithium niobate ($LiNbO_3$), lithium tantalate ($LiTaO_3$), chloric acid soda ($NaClO_3$), tourmaline, zincblende (ZuS), lithium sulfate ($LiSO_4H_2O$), lithium methagallate ($LiGaO_2$), lithium iodate ($LiIO_3$), glycine sulfate (TGS), bismuth germanate ($Bi_{12}GeO_{20}$), lithium germanate ($LiGeO_3$), barium titanate, and germanium ($9Ge_2TiO_3$).

(2) Piezoelectric semiconductors

Wurtzite, BeO, ZnO, CdS, CdSe, and AIN.

(3) Piezoelectric ceramics barium titanate ($BaTiO_3$), lead zirconate-lead titanate ($PbTiO_3.PbZrO_3$), lead titanate ($PbTiO_3$), barium lead niobate ((Ba-Pb) $N_9O_6$).

(4) The above-mentioned (1) piezoelectric crystal, (2) piezoelectric semiconductor and (3) piezoelectric ceramic powders can be broken down into plastic classes and formed.

(5) Piezoelectric polymers

Polyfluoride vinylidene PVDF $(—CH_2—CF_2—)_n$, Polyfluoride vinylidene/PZT, rubber/PZT, copolymer of torifluoro ethylene and fluoride vinylidene, copolymer of vinylidene cyanide and vinylidene acetate or poly (vinylidende cyanide).

After the piezoelectric material presented above undergoes the polarization process, it can be processed as a piezoelectric body and then used or after being processed as a piezoelectric body, undergo a polarization process and be used.

Piezoelectric Overcoat Process

The overcoat process of the above-mentioned piezoelectric bodies 26, 40 and 42 can be carried out by means of methods (1) to (5) presented below.

(1) Applying a plastic

Thermoplastic resin including saturated polyester resin, polyamide resin, polyimide resin, acrylic resin, aramid resin, ethylene vinyl acetate resin, ion cross-link olefin copolymer (ionomer), styrene butadiene block copolymer, polyacetal, polycarbonate, vinyl chloride vinyl acetate copolymer, cellulose ester, polyimide or styrene resin.

Heat cured resin including epoxy resin, phenoxy resin, urethane resin, nylon type, silicon resin, fluoro silicone resin, phenol resin, melamine resin, xylene resin, alkyd resin or heat cured acrylic resin.

Photoconductive resin including polyvinyl carbazole, polyvinyl pyrene, polyvinyl anthracene or poly vinyl alcohol.

These can be used independently or in combination.

In addition, mixtures of engineered plastics such as liquid crystal polymer, plastics with powders or whiskers can be used as well. Photosensitive resin or thick film photoresist resin can be used. Bakelite (phenol resin), fluororesin and glass epoxy resin (epoxy with glass filler mixed in) can also be used. These can use well-known liquid application methods including painting, dipping or spraying.

From among the above-mentioned materials, the effects of polyimide resin, aramid resin, epoxy resin, phenoxy resin, fluoro silicone resin, fluororesin and glass epoxy resin are especially excellent.

(2) Vapor Deposition of Metal Oxide, Nitride and Sulfide Compounds

Coating the piezoelectric body may also be accomplished with a metal oxide compound (such as $SiO_2$, SiO, CrO, $Al_2O_3$), a metal nitride compound (such as $Si_3N_4$, AIN), a metal sulfide compound (such as ZnS) or a combination of these using vacuum vapor deposition or sputtering.

Further, the plastics in the above-mentioned (1) can be applied by means of vapor deposition or parylene resin vapor deposition.

From among the above-mentioned materials, the effects of $Al_2O_3$ and $Si_3N_4$ are excellent.

(3) Application of Hydrocarbon Compounds

P-CVD (plasma CVD) is utilized to apply and overcoat the piezoelectric body with a IV group element contained hydrocarbon such as hydrocarbon, oxygen contained hydrocarbon and sulfur contained hydrocarbon; a halogen contained hydrocarbon such as nitrogen contained hydrocarbon, silicon contained hydrocarbon and fluorine contained hydrocarbon; or a III group element contained hydrocarbon. In addition, they can be applied by means of P-CVD under a mixing vapor phase of these.

From among the above-mentioned materials, the effects of fluorine contained hydrocarbon are excellent Moreover, depending on the compatibility of the adhesiveness with the piezoelectric body, these films require an undercoat to be suitably provided by means of a-Si (amorphous silicon), a-SiC or a-SiN.

(4) The plastic in the above-mentioned (1) forms the piezoelectric body by being substituted and impregnated in a piezoelectric formation portion by means of lowering the voltage in place of applying the plastic to the surface of the piezoelectric body plate surface in a liquid application state.

(5) Processing the surface of the piezoelectric body plate using a solvent with ink repelling properties.

If the overcoat films formed using the methods presented in (1) to (5) above are compared, the following characteristics can be seen (However, (3) is for with an undercoat.)

[i] Strength:

Strong (2), (3)>(1), (4)>(5) Weak

[ii] Smoothness:

Good (1), (4)>(2), (3), (5) Poor

[iii] Adhesive property (Including anti-vibration property.):

Strong (1), (4)>(2), (3)>(5) Weak

[iv] Durability (Including anti-ink property.)

Good (1), (4)>(2), (3)>(5) Poor

In addition, (5) is a convenient process and can also be utilized as the processes following (1) through (4). (1) and (4) are especially economical from the viewpoint of cost.

Moreover, the methods presented in the above-mentioned (1) to (5) can be suitably combined and used in accordance with the type of piezoelectric body and ink.

Top Plate and Substrate Materials

The following groups (1) to (4) can be used as the non-piezoelectric material comprising the top plate 20 and the substrate 24.

(1) Ceramics $Al_2O_3$, SiC, C, $BaTiO_3$, $BiO_3.3SnO_2$, Pb $(Zr_x,Ti_{1-x})O_3$, ZnO, $SiO_2$, (1−x) Pb $(Zr_x, Ti_{1-x})$ $O_3$+(x) $L_2O_3$, $Zn_{1-x}Mn_xFe_2O_3$, γ-$Fe_2O_3$, Sr.6$Fe_2O_3$, $L_{1-x}Ca_xCrO_3$, $SnO_2$, transition metal oxide, ZnO -$Bi_2O_3$, semiconductor $BaTiO_3$, β-$Al_2O_3$, stabilized zirconia, $L1_3$, 11C, diamond, TiN, TiC, $Si_3N_4$, $Y_2O_2S$:Eu, PLZT, $ThO_2$, -CaO.n$SiO_2$, $C_5$(F,Cl) $P_3O_{12}$, $TiO_2$, $K_2O.nAl_2O_3$.

(2) Glass

Element glass=Si, Se, Te, As

Hydrogen bond glass=$HPO_3$, $H_3PO_4$, $SiO_2$, $9O_2$, $P_2O_5$, $GeO_2$, $As_2O_3$ Glass oxide=$SbO_3$, $Bi_2O_3$, $P_2O_3$, $V_2O_5$, $S9O_5$, $As_2O_3$, $So_3$, $ZrO_2$ Glass fluoride=$BeF_2$, Glass chloride=$ZnCl_2$ Glass sulfide=$GeS_2$, $As_2S_3$ Glass carbonate=$K_2CO_3$, $MgCO_3$ Glass nitrate=$NaNO_3$, $KNO_3$, $AgNO_3$ Glass sulfate=$Na_2S_2O_3$, $H_2O$, $Tl_2SO_4$, alum Silicate glass=$SiO_2$ Silicate alkali glass=$N_2O$-CaO-$SiO_2$ Potassium lime glass=$K_2O$-CaO-$SiO_2$ Soda lime glass=$Na_2O$-CaO-$SiO_2$ Lead glass Barium glass Borosilicate glass (3) Plastics Thermoplastic resin including saturated polyester resin, polyamide resin, polyimide resin, aramid resin, acrylic resin, ethylene vinyl acetate resin, ion cross-link olefin copolymer (ionomer), styrene butadiene block copolymer, polyacetal, polycarbonate, vinyl chloride vinyl acetate copolymer, cellulose ester, polyimide or styrene resin.

Heat cured resin including epoxy resin, urethane resin, nylon resin, silicon resin, phenol resin, melamine resin, xylene resin, alkyd resin or heat cured acrylic resin.

Photoconductive resin including polyvinyl carbazole, polyvinyl pyrene, polyvinyl anthracene or poly vinyl alcohol.

The materials in (1) to (3) presented above can be used independently or in combination.

In addition, mixtures of engineered plastics such as liquid crystal polymer or plastics with powders or whiskers can be used as well.

Photosensitive resin or thick film photoresist resin can be used. Bakelite (phenol resin), fluororesin and glass epoxy resin (epoxy with glass filler mixed in) can also be used.

(4) Others

All metals can be used when an insulating film coat is applied to the side adjacent to the ink chamber.

These non-piezoelectric materials can either be processed into the top plate 20 after being made into a plate-like shape or formed into the shape of the top plate 20, or formed into the shape of the top plate 20 from the start using a die, pattern etching or optical hardening.

Partition Material

The groups shown below can be used as the material of the above-mentioned partition 22.

(1) Heat cured resin including epoxy resin, phenoxy resin, urethane resin, nylon, silicon resin, fluoro silicone resin, phenol resin, melamine resin, xylene resin, alkyd resin or heat cured acrylic resin.

From among the above-mentioned resins, epoxy resin, phenoxy resin and fluoro silicone resin can be appropriately used in particular.

(2) Thermoplastic resin including saturated polyester resin, polyamide resin, acrylic resin, aramide resin, ethylene vinyl acetate resin, ion cross-link olefin copolymer (ionomer), styrene butadiene block copolymer, polyacetal, polyphenylene sulfide, polycarbonate, vinyl chloride vinyl acetate copolymer, cellulose ester, polyimide or styrene resin.

From among the above-mentioned materials, aramide resin, polyimide resin, polyamide resin and ethylene vinyl acetate resin can be used appropriately in particular.

(3) Liquid crystal polymer (4) Photosensitive resin, thick film photoresist resin (5) Rubber, synthetic rubber (6) Thin plates including nickel, stainless steel, titanium or tungsten Further, the materials in (1) to (5) presented above can be used independently or in combination.

If the superior and inferior points of the materials presented in (1) to (6) above are compared, (1) to (3) are almost identical.

The following comparison can be seen.

Superior (1)–(3)>(4)>(6)>(5) Inferior

Furthermore, it is preferable for the thickness of the material to be 100 μm or less and, if possible, 50 μm or less.

Adhesive Agent Material

The following groups (1) to (4) can be used for the material of the adhesive agent used to assemble the ink jet head 12. However, the adhesive agent used to attach the piezoelectric body 26 to the substrate 24 must be conductive.

(1) Heat cured resin adhesive agent including epoxy resin, phenol resin, phenoxy resin, acrylic resin, furan resin, polyurethane resin, polyimide resin, or silicon resin.

(2) Thermoplastic resin adhesive agent including polyvinyl acetate, polyvinyl chloride, vinyl acetyl, polyvinyl alcohol, or polyvinyl butyral.

(3) UV cured resin adhesive agent (4) Anaerobic cured adhesive agent

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An ink jet recording apparatus comprising:

a member made of a non-piezoelectric material in which a plurality of ink chambers are formed, each ink chamber having a longitudinal direction, each ink chamber having an outer wall, said outer wall including a membrane; and a piezoelectric member having a comb-toothed shape including a plurality of tooth portions and a coupling portion, said tooth portions being coupled with said coupling portion, each of said tooth portions corresponding to one of said ink chambers;

wherein each of said tooth portions has a plurality of surfaces including a first surface parallel to said longitudinal direction, each of said first surfaces being fixedly connected to said membrane, said longitudinal direction of said ink chambers and said longitudinal direction of said tooth portions being parallel, wherein each of said tooth portions deforms in a substantially longitudinal direction in response to an input signal, said fixed connection between said membrane and said first surface constraining said deformation in said longitudinal direction at said first surface.

2. An ink jet recording apparatus as claimed in claim 1, wherein said member made of a non-piezoelectric material is formed in the shape of a plate having a surface on which a plurality of grooves are formed, and wherein said membrane is a film which is provided on said surface to cover said grooves, a space being formed between each of said grooves and said film being defined as said ink chamber.

3. An ink jet recording apparatus as claimed in claim 2, wherein said film is made of a resin material.

4. An ink jet recording apparatus as claimed in claim 1, wherein each of said tooth portions are connected with said membrane by adhesive.

5. An ink jet recording apparatus as claimed in claim 1, wherein each of said tooth portions is substantially coated with a resin material so that moisture absorption by said tooth portions is substantially prevented.

6. An ink jet recording apparatus as claimed in claim 5, wherein said resin material is polyimide.

7. An ink jet recording apparatus as claimed in claim 1, wherein said tooth portions each having a plurality of surfaces including a first surface parallel to said longitudinal direction also includes other surfaces, and wherein said other surfaces of each of said tooth portions are not constrained in deformation.

8. An ink jet recording apparatus as claimed in claim 1, wherein said deformation in said longitudinal direction of said each of said tooth portions in response to an input signal causes said tooth portion to buckle as a result of said first surface being constrained in deformation, said buckling acting to displace said membrane relative to said ink chamber.

9. An ink jet recording apparatus comprising:

a film which is made of a non-piezoelectric material, said film having a first surface and a second surface opposing said first surface;

a first member on which a plurality of first grooves are formed, said first member being in contact with said first surface of said film so that each of said first grooves is covered with said film, a space formed between each of said first grooves and said film being defined as an ink chamber;

a plurality of piezoelectric members each of which deforms in response to an input signal, each of said piezoelectric members being fixedly provided on said second surface of said film opposite one of said plurality of first groves; and a second member on which a plurality of second grooves are formed, each of said second grooves corresponding to one of said first grooves, said second member being in contact with said second surface of said film and aligned so that each of said second grooves confronts one of said first grooves;

wherein each of said piezoelectric members is disposed within one of said second grooves on said second member, each of said piezoelectric members being noncontacting with said second member.

10. An ink jet recording apparatus as claimed in claim 9, wherein said film is made of a resin material.

11. An ink jet recording apparatus as claimed in claim 9, wherein each of said piezoelectric members is substantially coated with a resin material so that moisture absorption by said piezoelectric members is substantially prevented.

12. An ink jet recording apparatus as claimed in claim 11, wherein said resin material is polyimide.

13. An ink jet recording apparatus as claimed in claim 9, wherein each of said piezoelectric members are connected with said film by adhesive.

14. An ink jet recording apparatus comprising:

a film which is made of a non-piezoelectric material, said film having a first surface and a second surface opposing said first surface;

a first member on which a plurality of first grooves are formed, each of said grooves having a longitudinal direction, said first member being in contact with said first surface of said film so that each of said first grooves is covered with said film, a space formed between each of said first grooves and said film being defined as an ink chamber; and a piezoelectric member having a comb-toothed shape including a plurality of tooth portions and a coupling portion, said tooth portions being coupled with said coupling portion, each of said tooth portions extending in a longitudinal direction from said coupling portion, each of said tooth portions being provided on said second surface of said film opposite one of said plurality of first grooves;

wherein each of said tooth portions has a plurality of surfaces including a longitudinal surface parallel to said longitudinal direction, said longitudinal surface being fixedly connected to said second surface of said film, said longitudinal direction of said tooth portions and said longitudinal direction of said grooves being parallel, and wherein each of said tooth portions deforms in a substantially longitudinal direction in response to an input signal, said fixed connection between said longitudinal surface and said second surface of said film constraining said deformation in said longitudinal direction at said longitudinal surface.

15. An ink jet recording apparatus as claimed in claim 14, wherein said film is made of a resin material.

16. An ink jet recording apparatus as claimed in claim 14, wherein at least a portion of each of said tooth portions is coated with a resin material.

17. An ink jet recording apparatus as claimed in claim 16, wherein said resin material is polyimide.

18. An ink jet recording apparatus as claimed in claim 14, wherein each of said tooth portions are connected with said film by adhesive.

19. An ink jet recording apparatus as claimed in claim 14, wherein each of said tooth portions includes an end portion, said end portions of each of said tooth portions being connected together.

20. An ink jet recording apparatus as claimed in claim 14, wherein said plurality of tooth portions each having a plurality of surfaces including a longitudinal surface parallel to said longitudinal direction also includes other surfaces, and wherein said other surfaces are not constrained in deformation.

21. An ink jet recording apparatus as claimed in claim 14, wherein said deformation in a longitudinal direction of each of said tooth portions in response to an input signal causes each of said tooth portions to buckle as a result of said longitudinal surface being constrained in deformation, said buckling acting to displace said film relative to said ink chamber.

22. An ink jet recording apparatus comprising:

a film which is made of a non-piezoelectric material, said film having a first surface and a second surface opposing said first surface;

a first member on which a plurality of first grooves are formed, said first member being in contact with said first surface of said film so that each of said first grooves is covered with said film, a space formed between each of said first grooves and said film being defined as an ink chamber;

a plurality of piezoelectric members each of which deforms in response to an input signal, each of said piezoelectric members being fixedly provided on said second surface of said film opposite one of said plurality of first groves; and a second member on which a plurality of second grooves are formed, each of said second grooves corresponding to one of said first grooves, said second member being in contact with said second surface of said film and aligned so that each of said second grooves confronts one of said first grooves;

wherein each of said piezoelectric members is disposed within one of said second grooves on said second member, each of said piezoelectric members disposed within one of said second grooves on said second member being separated from said second member by a gap, said gap being smaller than a transverse dimension of said piezoelectric members.

23. An ink jet recording apparatus as claimed in claim 22, wherein said plurality of piezoelectric members, each of which deforms in a substantially longitudinal direction in response to an input signal, are each substantially prevented from a twisting deformation as a result of being disposed within one of said second grooves on said second member.

24. The ink jet recording apparatus as claimed in claim 16, wherein each of said tooth portions is substantially encapsulated by a resin material, except for said longitudinal surface, so that said tooth portions are substantially prevented from absorbing moisture from an ambient atmosphere.

25. An ink jet recording apparatus comprising:

a film which is made of non-piezoelectric material, said film having a first surface and a second surface opposing said first surface;

a first member on which a plurality of grooves are formed, said first member being in contact with said first surface of said film so that each of said grooves is covered with said film, a space formed between each of said grooves and said film being defined as an ink chamber; and a second member made of a piezoelectric material and having a comb-toothed shape, said second member including a plurality of tooth portions and a coupling portion, each of said tooth portions being coupled by said coupling portion, each of said tooth portions having an elongated strip shape extending in a longitudinal direction from said coupling portion and a surface parallel with said longitudinal direction;

wherein for each of said tooth portions said surface parallel with said longitudinal direction of said tooth portion is connected with said second surface of said film opposite one of said ink chambers, said longitudinal direction of said elongated strip shape and said second surface of said film being parallel.

26. The ink jet recording apparatus as claimed in claim 25, wherein each of said tooth portions of said second member deforms mainly in said longitudinal direction.

27. An ink jet recording apparatus comprising:

a film which is made of non-piezoelectric material, said film having a first surface and a second surface opposing said first surface;

a first member on which a plurality of grooves are formed, said first member being in contact with said first surface of said film so that each of said grooves is covered with said film, a space formed between each of said grooves and said film being defined as an ink chamber; and a second member made of a piezoelectric material and having a comb-toothed shape, said second member including a plurality of tooth portions and a coupling portion, each of said tooth portions being coupled by said coupling portion, each of said tooth portions having an elongated strip shape extending in a longitudinal direction and a surface parallel with said longitudinal direction;

wherein for each of said tooth portions said surface parallel with said longitudinal direction of said tooth portion is connected with said second surface of said film opposite one of said ink chambers;

wherein said coupling portion of said second member does not substantially deform.

28. The ink jet recording apparatus as claimed in claim 25, wherein each of said tooth portions of said second member has an individual electrode and a common electrode, and said common electrodes are electrically connected to each other.

29. The ink jet recording apparatus as claimed in claim 28, wherein said common electrodes are electrically connected at said coupling portion of said second member.

30. An ink jet recording apparatus comprising:

a film which is made of non-piezoelectric material, said film having a first surface and a second surface opposing said first surface;

a first member on which a plurality of first grooves are formed, said first member being in contact with said first surface of said film so that each of said first grooves is covered with said film, a space formed between each of said first grooves and said film being defined as an ink chamber;

a plurality of piezoelectric members each of which deforms in response to an input signal, each of said piezoelectric members being fixedly provided on said second surface of said film opposite one of said first grooves; and a second member on which a plurality of second grooves and a plurality of protrusions are formed alternatively, said protrusions being in contact with said second surface of said film so that each of said second grooves contains at least one of said piezoelectric members therein;

wherein each of said piezoelectric members has an elongated strip shape extending in a longitudinal direction, and each of said piezoelectric members are connected to each other at an end with respect to the longitudinal direction, said longitudinal direction of said elongated strip shape and said second surface of said film being parallel.

31. The ink jet recording apparatus as claimed in claim 30, wherein each of said piezoelectric members has an individual electrode and a common electrode, and each of said common electrodes are electrically connected to each other.

* * * * *